US005265794A

United States Patent [19]

Johnston

[11] Patent Number: 5,265,794

[45] Date of Patent: Nov. 30, 1993

[54] TAMPER EVIDENT FOLDING CARTON

[75] Inventor: Alan Johnston, New Haven, Conn.

[73] Assignee: Rexham Corporation, Charlotte, N.C.

[21] Appl. No.: 947,654

[22] Filed: Sep. 17, 1992

Related U.S. Application Data

[63] Continuation-in-part of Ser. No. 819,464, Jan. 10, 1992, Pat. No. 5,148,970.

[51] Int. Cl.[5] ..... B65D 5/42

[52] U.S. Cl. ..... 229/102; 206/459.5; 206/807

[58] Field of Search ..... 229/102, 132; 206/807, 206/459.5

[56] References Cited

U.S. PATENT DOCUMENTS

| | | | |
|---|---|---|---|
| 4,475,661 | 10/1984 | Griffin | 206/807 |
| 4,526,752 | 7/1985 | Perlman et al. | 206/807 |
| 4,746,052 | 5/1988 | Schmissrauter | 229/102 |
| 4,770,338 | 9/1988 | Tatusch | 229/102 |
| 4,838,708 | 6/1989 | Holcomb et al. | 206/807 |
| 4,998,666 | 3/1991 | Ewan | 229/102 |
| 5,005,719 | 4/1991 | Phillips et al. | 229/102 |
| 5,060,848 | 10/1991 | Ewan | 229/102 |
| 5,148,970 | 9/1992 | Johnston | 229/102 |

FOREIGN PATENT DOCUMENTS

| | | | |
|---|---|---|---|
| 342162 | 1/1931 | United Kingdom | 229/102 |
| 2229424 | 9/1990 | United Kingdom | 229/102 |

*Primary Examiner*—Gary E. Elkins
*Attorney, Agent, or Firm*—Schweitzer, Cornman & Gross

[57] ABSTRACT

A tamper evident folding carton having tamper indicating seals at opposite ends, each of which ends comprise four infolded flaps sealed to one another through registered slots in the intermediate flaps, which seals will be triggered by an attempted violation of carton integrity through the carton side seam.

10 Claims, 3 Drawing Sheets

TAMPER EVIDENT FOLDING CARTON

RELATED APPLICATION

This application is a continuation-in-part of pending U.S. application Ser. No. 819,464 filed Jan. 10, 1992, now U.S. Pat. No. 5,148,970.

BACKGROUND OF THE INVENTION

The present invention is directed generally to the field of tamper evident packaging and more particularly to tamper evident folding cartons of the type having a tamper evidencing "flagging device" or other readily visible indicating device incorporated into the carton closure.

SUMMARY OF THE PRESENT INVENTION

Specifically the present invention is directed to folding cartons in which the "flagging device" or tamper-indicating means is in the nature of a latent message or signal disposed in a window at the carton end which signal appears when the carton is opened. For example the latent message may be the word "opened" or a color change which will appear at the end of the carton in the window when the carton flap has been opened. While the carton is closed and untampered with, the window has an empty colored panel which is visible to a potential user without any message or signal of opening.

Tamper evident labels have been utilized for externally sealing folding cartons and other packages so as to provide some indication of unauthorized opening or tampering. Such labels typically include latent graphics formed on the labeling medium which become visible when the label is opened, disrupted or its integrity compromised.

Certain dramatic improvements in tamper indicating labeling materials and tamper indicating seals have recently been developed by the 3M Company and others. These tamper indicating seals may be employed in envelopes, security deposit bags, folding cartons, and other containers having overlying closure flaps. Advantageously, the seals, when opened, display a readily visible "flagging" message or signal indicating that the integrity of the sealed carton has been disrupted. The specific structures of such tamper indicating seals are disclosed in U.S. Pat. Nos. 4,937,040 and 4,838,708 owned by Minnesota Mining and Manufacturing Company, St. Paul, Minn. and U.S. Pat. No. 4,998,666 owned by Sealcraft Corporation.

While the recently developed tamper indicating seals have shown great promise and potential utility, their incorporation into an inexpensive, commercially acceptable, folding carton construction in a manner which will defeat and inhibit determined tampering has not been accomplished heretofore in a manner which has been acceptable to the Food and Drug Administration (FDA). Many earlier proposals have been subject to undetected tampering by invasion of the carton through a careful severing and regluing of the side seam without triggering the tamper evident seal. Previously it has been proposed to insert the new tamper evident seals in the last folded flaps on opposite ends of an otherwise conventional folding carton. Unfortunately this has permitted tampering to be effected by cutting under the glue and/or over the label while leaving the tamper evident seals intact.

Accordingly, the present invention is directed to a new and improved sealed end construction of an otherwise conventional folding carton including a tamper evident seal on opposite ends of the carton. An earlier solution utilizing dissimilar end closures was developed and is described in said pending application, now U.S. Pat. No. 5,148,970, dated Sep. 22, 1992. The patented construction results in one or the other of the seals in opposite ends being triggered by an attempted invasion of the carton through a glued side seal and requires special modifications of carton-making equipment owing to different folding sequences at the opposite ends.

While this patented structure had great initial promise, it failed to receive FDA acceptance and the carton was found to have limited commercial acceptance based on difficulties in running it on the type of conventional automatic cartoning equipment generally found at pharmaceutical companies. To obviate those problems, the new and improved tamper-evident carton of the present invention has been developed. The new carton has been deemed acceptable by the FDA and has the advantage of being able to be erected on existing cartoning equipment commonly found in pharmaceutical plants. Indeed, the new carton may be erected with standard equipment and without modification of the end closing flap-folding sequence, which sequence is identical for both ends of the carton. With a single injection or shot of glue or hot melt the four end closing flaps are sealed, one to one another, with the tamper-indicating seal being disposed on the last-folded end flaps.

For a better understanding of the present invention and a greater appreciation of its many attendant advantages, reference should be made to the accompanying drawings taken in conjunction with the following detailed description.

DETAILED DESCRIPTION OF THE INVENTION

Figure 1:
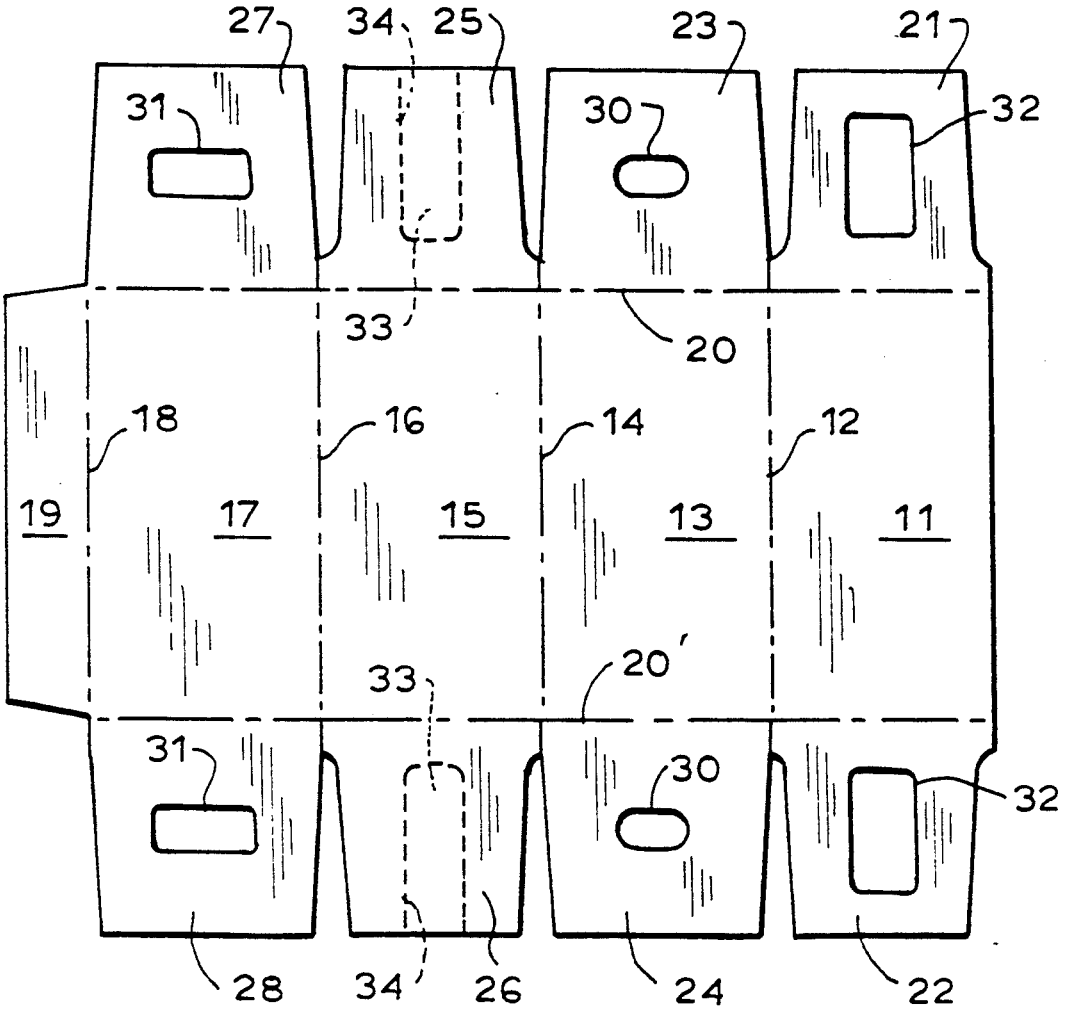
FIG. 1 is a plan view of a folding carton blank from which the new and improved tamper evident folding carton may be erected.

Referring now to FIG. 1, the new and improved carton blank of the present invention includes a first (or side) wall panel 11 articulated along a score line 12 to a second (or front) panel 13 which is in turn articulated along a score line 14 to a third (or side) wall panel 15 which in turn is articulated along a score line 16 to fourth (or rear) wall panel 17 which is articulated along a score line 18 to a glue lap 19. Articulated to the upper edges of the panels 11,13,15, and 17, along an upper horizontal score line 20 are a first (side) top flap 21, a second top (front) flap 23, a third top (side) flap 25, and a fourth (rear) top flap 27. Similarly articulated along a lower horizontal score line 20 to the bottom edges of the carton panels 11,13,15 and 17, are first bottom (side) flap 22, second bottom (front) flap 24, third bottom (side) flap 26, and fourth bottom (rear) flap 28. The flaps 21, 23, 25 and 27 are identical to the flaps 22, 24, 26 and 28.

In accordance with the principles of the invention tamper indicating seals 40 (FIG. 5) of the general type described in the aforementioned patents are superimposed upon windows 30 formed in the outermost end flap 23, 24 on each end of the carton. Slot 31 formed in each of the end flaps 27 and 28 which slots will be in registry with the slot 30 when the carton is assembled in a conventional manner as described in detail hereinafter. In accordance with the invention, the slots 31 are similar in shape but slightly larger in size than the slots 30.

Slots 32, similar in shape but slightly larger than the slots 31, are formed on the end flaps 21 and 22. A removable or tear-away tab 33 is formed on each of the end flaps 25 and 26 by a U-shaped line of weakness 34 comprised of spaced cuts and nicks or other perforations extending from the edges of the flaps 25 and 26. The tabs 33 are arranged to underlie slots 32. The carton blank is formed into a flattened tube by folding panels 17 and 11 along lines 12 and 16 and gluing panel 11 to glue lap 19 by a seam 61.

In accordance, with the principles of the invention both the upper end and lower end of the carton may be closed by conventional carton making equipment, after the flattened tube is squared (FIG. 2), as follows:

Flaps 25 and 26 are infolded. Thereafter, the flaps 21, 22 are infolded so that the slots 32 are superimposed over the tabs 33. Thereafter the flaps 27, 28 are infolded so that the slots 31 are superimposed over slots 32. Next, at this stage of end flap folding (shown at the top of FIG. 2), a slug of adhesive is injected into the superimposed slots 31 and 32. While the adhesive is still tacky and adhering to the tab 33 and the edges of the registered slots 31 and 32, the flap 23 is infolded so that the adhesive 50 contacts the underside of the flap 23 as well as the underside of the tamper indicating seal 40. Thus, in accordance with the principles of the invention, a single shot of adhesive, glue, or hot melt 50 communicates with and joins all four end flaps of the carton, adhering the last-folded end flap to the first-folded end flap through the second and third-folded end flaps.

In accordance with the invention, the special tamper indicating seals 40 are securely adhered to the outer surface of the top front flap 23 and the bottom front flap 24. As shown best in FIG. 6, the tamper indicating seals 40 are of the general construction disclosed in U.S. Pat. Nos. 4,998,666 and in 4,937,040 the disclosures of which patents are incorporated by reference herein. The bottom end of the carton is closed and sealed in the same sequence as the top end.

Figure 6:
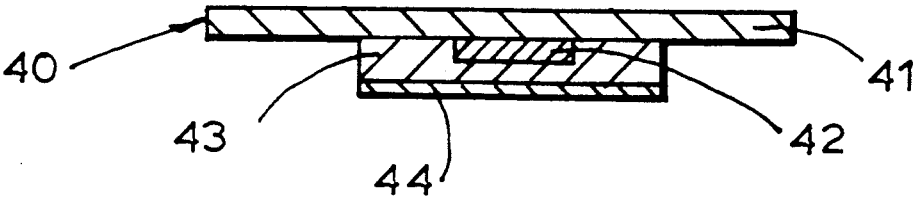
FIG. 6 is a cross-sectional view of the type of tamper indicating seal employed in the practice of the invention.

Referring now to FIG. 6, the tamper indicating seal 40 includes a carrier of transparent or paper material 41, e.g., polyester, polyethylene, polypropylene, copolymers thereof or the like. The film 41 is of a size slightly greater than the window openings 30. The film is adhered to the outer surfaces of the flaps 23 and 24 by an adhesive (not shown) which securely fastens the tamper indicating seal 40 to the outer surface of those flaps. On the same side of the film 41 in registry with the window portion 30 is a transparent masking material 42 which forms a printed pattern for the word "opened" or whatever other expression or signaling of carton opening is chosen. The masking pattern 42 is coated with a primer 43 which in turn is coated with a colorant 44. In accordance with the teachings of the aforementioned U.S. Pat. Nos. 4,937,040 and 4,998,666 the primer 43 facilitates adhesion of the colorant layer 44 to the film 41 in those areas in which the masking material 42 is not present. However, when the colorant has a high affinity for the film material 41 of the primer 43 may not be necessary.

Figure 5:
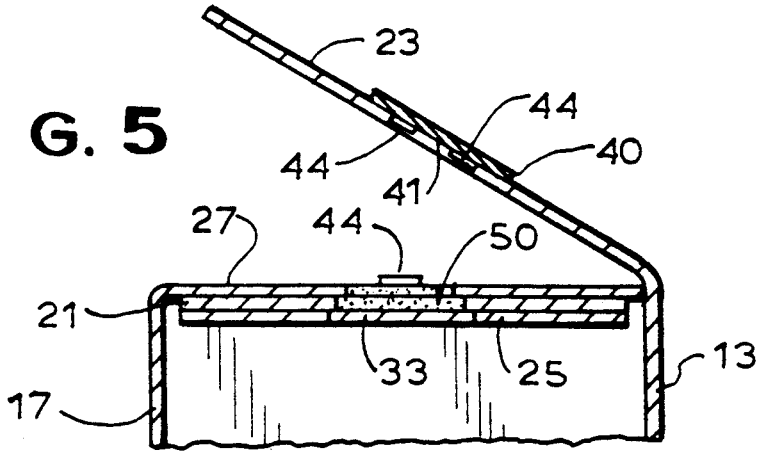
FIG. 5 is a cross-sectional view showing the opened carton end with the tamper evidencing seal triggered to provide a message.
Figure 2:
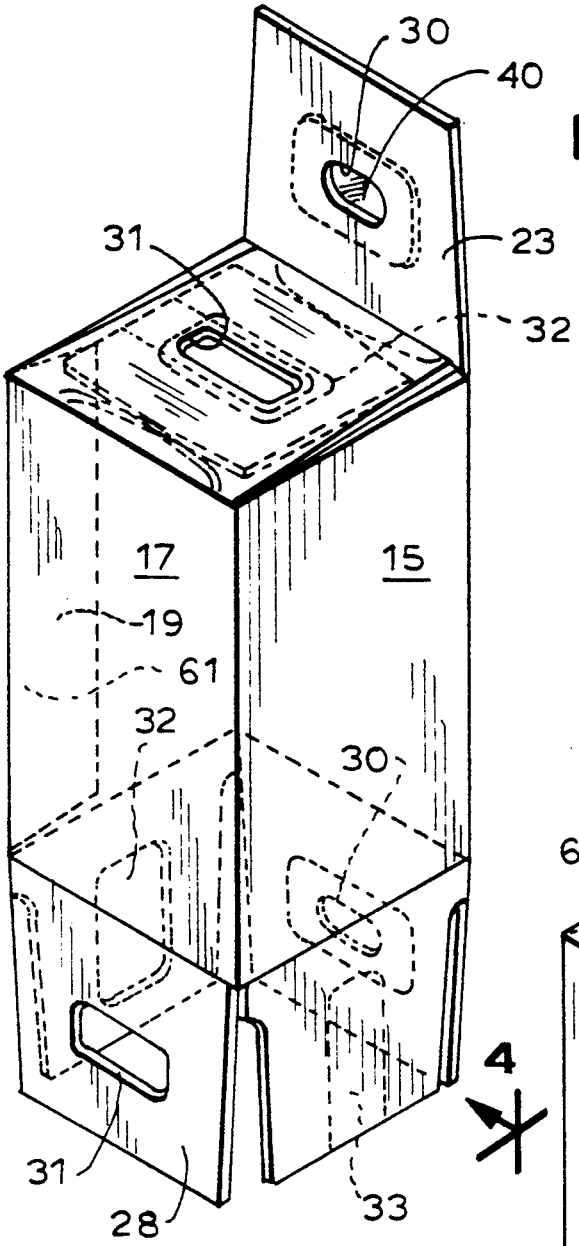
FIG. 2 is a perspective view of a carton blank which has been folded, glued and squared prior to final completion of carton erection by the sequential folding and sealing of the end flaps by conventional equipment.
Figure 3:
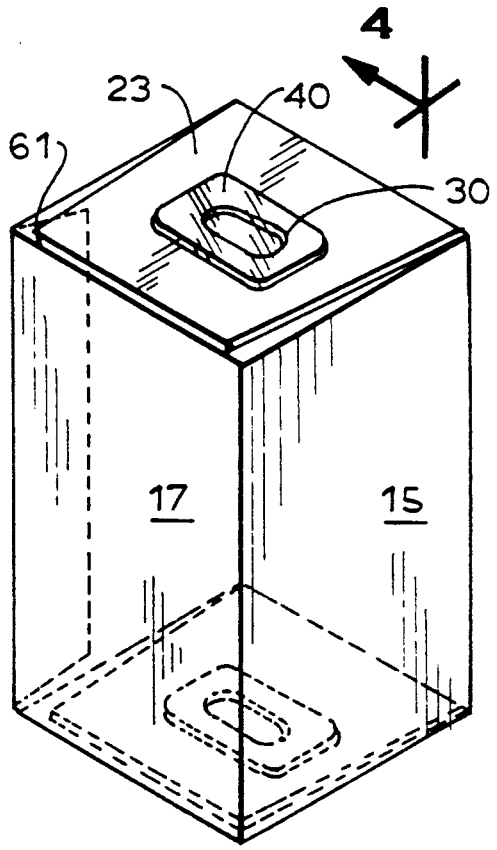
FIG. 3 is a perspective view of a folded and sealed carton embodying the principles of the invention.
Figure 4:
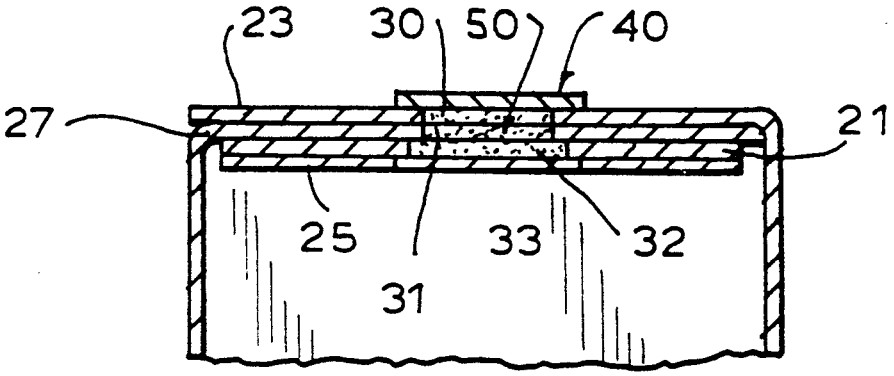
FIG. 4 is a cross-sectional view of the carton taken along line 4—4 of FIG. 3.

To summarize, the new and improved parallelpiped carton 60 of the present invention, with tamper evident opening features incorporated at its opposite ends, is formed by initially establishing a flat-folded carton tube by adhering with adhesive the glue lap 19 to the first side panel 11 to form a side seam 61. The carton tube is subsequently squared, as shown in FIG. 2, so that the front and rear walls are parallel and the side walls are parallel. Thereafter, in accordance with the principles of the invention, the top end of the carton 60 is closed on conventional equipment by first folding the flap 25, thereafter folding the flap 21, and then folding the flap 27. At this stage, in accordance with the invention, a slug of adhesive 50 is precisely deposited or shot through the adhesive slot openings 30 and 31 and, thereafter, while the adhesive is tacky, the top front panel 23 is folded down upon the flap 27. This will securely adhere flap 23 to the underlying flap 27 as well as to the flaps 21 and 25 as shown in FIG. 4. It will be understood that the adhesive 50 covers and adheres to the colorant layer 44 of the tamper evident seal 40 which is coated over the transparent masking material 42. Thus upon the unsealing of the flap 23 from the underlying flap 27 the adhesive 50 will selectively dislodge portions of the colorant layer in the area of masking 42 from the tamper evidencing seal 40 and will retain those dislodged portions on the deposited adhesive which is adhered to the flap 27 and is exposed through the adhesive slot 31 as shown in FIG. 5. The "flagging" indicator i.e., the word "opened" will be formed at the removal of colorant in the area of masking on the film 41 and thus the word "opened" will be visible through the film 41 at the window 30 on the flap 23 and the word "opened" (in reverse printing from that in the window) will also appear on the slug of adhesive 50 by virtue of the selective transfer of the colorant layer to the adhesive 50. This is due to the fact that the masking material 42 possesses low adhesion properties with respect to the transparent or translucent film 41 and differential adhesion will occur. Portions of the colorant layer 44 remain on the film and are visible at the window 30 while dislodged colorant portions remain on the adhesive on the underlying flap. The chosen pattern of the masking material will determine the appearance or wording of the tamper evident symbol which becomes visible upon the dislodging of the colorant. As discussed hereinabove, this type of tamper evidencing seal is disclosed in detail in U.S. Pat. Nos. 4,998,666 and 4,937,040, the disclosures of which are incorporated herein by reference.

By shooting or otherwise depositing glue or adhesive through both the inner major glue flap and one of the dust flaps, undetected tampering entry through the side seam is no longer possible as was the case in earlier cartons which utilized tamper evident seals in the last-folded end flap. Indeed, glue which was shot directly onto a flap or into a single hole in early cartons in the inner major glue flap could be removed from the flap by carefully cutting under the glue in the seam. Thus, the side seam could be severed and the side panel of the carton could be opened for tampering, without disturbing the ends, and then reglued. The ultimate user would be unable to detect that the carton integrity had in fact been compromised, since the tamper indicating seal on the unopened end had never been actuated.

However, in accordance with the present invention, the glue flap 21 anchors the carton in such a way that if seam 61 is severed, panel 11 cannot be pulled out from the squared carton body without the destruction of an end of the carton or the actuation of the tamper indicating seal 40. Since the glue is shot through two slots 31, 32 and onto a perforated flap 25, attempts to cut under the glue without detection cannot succeed since it is difficult to slide a knife or razor blade under the glue plug and any attempts to pry at the plug 50 will cause the perforated tab 33 to separate from flap 25. Further carton security and enhanced resistance to attempts to sever the glue plug is provided by the geometry of the slots 32, 31 on flaps 21 and 27. Thus, in accordance with the invention, by making the slot 31 on flap 27 smaller than the slot 32 on the flap 21 a shoulder is formed on the glue plug 50 which shoulder inhibits a would-be tamperer from prying out the glue plug without destruction of the end flaps.

While the present invention has been described with reference to a particular preferred embodiment, it should be appreciated that certain variations and modifications may be made by those skilled in the art. For example, in some versions of the carton the tabs 31 may be simple glue receiving zones and the lines of weakness 34 may be omitted. Accordingly, the invention is to be limited only as set forth in the appended claims.

I claim:

1. A tamper-evident folding carton having (a) first, second, third, and fourth walls three of which are articulated to one another along parallel score lines, the fourth of which is adhered by adhesive to the first by a glue lap articulated to the fourth wall;

(b) first, second, third and fourth top and bottom end closing flaps articulated respectively to top and bottom of each said first, second, third, and fourth walls;

(c) viewing windows formed in the top and bottom end flaps of said second panel;

(d) first adhesive closure slots formed in top and bottom end flaps of a fourth panel and said adhesive closure slots are adapted to underlie said viewing windows in registry therewith;

(e) second adhesive closure slots similar in shape to said first slots formed in the top and bottom end flaps of said first wall;

(f) top and bottom ends of said carton being established and closed by sequential infolding respectively of said third flap; said first flap; said fourth flap; and said second flap;

(g) adhesive closure means deposited in the form of a slug in said first and second closure slots and adhering said windowed flaps to both said underlying first and fourth slotted flaps and also to the third end flaps underlying both of said slotted flaps; and (h) tamper indicating seals adhered to said windowed second flaps and closing off said windows; said seals including a carrier having tamper indicating means of low adhesion material adapted to create an irreversible flagging indicia viewable through said carrier at said window when said adhesive closure means sealing said windowed flaps to said underlying flaps has been disrupted by carton-opening or tampering motion.

2. The carton of claim 1 in which (a) said seals are applied to outer surfaces of said carton and closing flaps.

3. The carton of claim 1 in which (a) tear-away tabs adapted to separate from the carton are formed in said third end flaps, the separation of one of said tabs from the third end flap in which it is formed indicating opening or tampering.

4. The carton of claim 3 in which (a) said tear-away tabs are formed by a U-shaped line of weakness terminating at outer edges of said flaps.

5. The carton of claim 1 in which (a) said second adhesive closure slots are slightly larger than said first adhesive closure slots.

6. A paperboard blank for a tamper-evident folding carton, said blank cut and scored to include (a) first, second, third, and fourth wall panels three of which are articulated to one another along parallel score lines and the fourth of which is articulated to a glue lap;

(b) first, second, third and fourth top and bottom end closing flaps articulated respectively to top and bottom edge portions of each said first, second, third, and fourth wall panels;

(c) viewing windows formed in the top and bottom end flaps of said second panel;

(d) first adhesive closure slots formed in the top and bottom end flaps of said fourth panel and said adhesive closure slots are adapted to underlie said viewing windows in registry therewith when the blank is folded into a carton;

(e) second adhesive closure slots similar in shape to said first slots formed in the top and bottom end flaps of said first wall;

(f) tamper indicating seals adhered to said windowed second flaps and closing off said windows; said seals including a carrier having tamper indicating means of low adhesion material adapted to create an irreversible flagging indicia viewable through said carrier at said window when said adhesive closure means sealing said windowed flaps to said underlying flaps has been disrupted by carton-opening or tampering motion.

7. The blank of claim 6 in which (a) said seals are applied to outer surfaces of said closing flaps.

8. The blank of claim 6 in which (a) a tear-away tab adapted to separate from the carton is formed on at least one of said third end flaps.

9. The blank of claim 6 in which (a) said tear-away tab is formed by a U-shaped line of weakness terminating at the outer edge of said at least one flap.

10. The blank of claim 6 in which (a) said second closure slots are larger than said first closure slots.

* * * * *